US010443295B2

(12) United States Patent
Huggins et al.

(10) Patent No.: US 10,443,295 B2
(45) Date of Patent: Oct. 15, 2019

(54) GARAGE DOOR OPENER SYSTEM HAVING AN INTELLIGENT AUTOMATED ASSISTANT AND METHOD OF CONTROLLING THE SAME

(71) Applicant: TTI (MACAO COMMERCIAL OFFSHORE) LIMITED, Macau (MO)

(72) Inventors: Mark Huggins, Anderson, SC (US); J. Porter Whitmire, Greenville, SC (US); Michael Preus, Piedmont, SC (US); Scott Kippes, Piedmont, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 0 days.

(21) Appl. No.: 15/967,032

(22) Filed: Apr. 30, 2018

(65) Prior Publication Data

US 2018/0245395 A1 Aug. 30, 2018

Related U.S. Application Data

(63) Continuation-in-part of application No. 15/828,742, filed on Dec. 1, 2017.

(Continued)

(51) Int. Cl.
*E05F 15/77* (2015.01)
*E05F 15/76* (2015.01)

(Continued)

(52) U.S. Cl.
CPC ..... *E05F 15/76* (2015.01); *E05F 15/668* (2015.01); *E05F 15/684* (2015.01); *E05F 15/77* (2015.01);

(Continued)

(58) Field of Classification Search
None
See application file for complete search history.

(56) References Cited

U.S. PATENT DOCUMENTS 7,194,412 B2 * 3/2007 Mays ..... G10L 15/26 340/5.71
7,464,035 B2 * 12/2008 Funk ..... H04L 12/2803 704/270

(Continued)

FOREIGN PATENT DOCUMENTS

EP 1280109 1/2003
WO 2015077222 5/2015

OTHER PUBLICATIONS

Extended European Search Report for Application No. 17204957.9 dated Apr. 30, 2018, 9 pages.

(Continued)

*Primary Examiner* — K. Wong
(74) *Attorney, Agent, or Firm* — Michael Best & Friedrich LLP

(57) ABSTRACT

A garage door opener system includes a garage door opener having a motor for moving a garage door and a controller coupled to a wireless communication interface, a user communication interface including a microphone, and a garage door opener accessory. The controller controls the garage door opener motor to move the garage door, detects a command from a user via the microphone, authenticates the command, and generates a responsive control action to control the garage door opener accessory. The user interface may include a speaker that produces an audible response to the user. The accessory may include an object tracker that alerts a user with an audible or illuminating alert. Other accessories may include a video camera, a radio, a music (Continued)

player, a battery charger, an energy storage system, a garage door lock, a hinged lid, an entry door, and a window lock.

20 Claims, 14 Drawing Sheets

Related U.S. Application Data

(60) Provisional application No. 62/429,575, filed on Dec. 2, 2016.

(51) Int. Cl.

| | |
|---|---|
| ***E05F 15/668*** | (2015.01) |
| *E05F 15/684* | (2015.01) |
| *E06B 3/70* | (2006.01) |
| *E05F 15/73* | (2015.01) |
| *G07C 9/00* | (2006.01) |

(52) U.S. Cl.

CPC ... *E05F 2015/765* (2015.01); *E05F 2015/767* (2015.01); *E05Y 2400/80* (2013.01); *E05Y 2400/816* (2013.01); *E05Y 2400/85* (2013.01); *E05Y 2800/00* (2013.01); *E05Y 2900/106* (2013.01); *E06B 2003/7044* (2013.01); *G07C 2009/00928* (2013.01)

(56) References Cited

U.S. PATENT DOCUMENTS

| | | | | |
|---|---|---|---|---|
| 7,996,231 | B2 | 8/2011 | Mays | |
| 9,253,288 | B2 * | 2/2016 | Binenstock | H04L 63/0492 |
| 9,800,429 | B2 * | 10/2017 | Crayford | H04L 12/2803 |
| 9,805,721 | B1 * | 10/2017 | Lindsay | G10L 15/265 |
| 2003/0018478 | A1 | 1/2003 | Mays | |
| 2010/0127882 | A1 * | 5/2010 | Sitarski | E05F 15/77 340/686.1 |
| 2016/0258202 | A1 * | 9/2016 | Scalisi | G07C 9/00309 |
| 2017/0294113 | A1 | 10/2017 | McNabb | |
| 2017/0295658 | A1 | 10/2017 | Whitmire et al. | |

OTHER PUBLICATIONS

Amazon.com, Inc., "Amazon Echo Bluetooth Speaker with Alexa," <https://www.amazon.com/Amazon-Echo-Bluetooth-Speaker-with-Alexa-Black/dp/B00X4WHP5E> webpage available at least as early as May 9, 2017.

Apple Inc., "Hey Siri," <https://www.apple.com/ios/siri/> webpage available at least as early as Sep. 15, 2012.

Google, LLC., "Google Home Mini," <https://store.google.com/us/product/google_home_mini?hl=en-US> webpage available at least as early as Oct. 5, 2017.

* cited by examiner

GARAGE DOOR OPENER SYSTEM HAVING AN INTELLIGENT AUTOMATED ASSISTANT AND METHOD OF CONTROLLING THE SAME

RELATED APPLICATIONS

This application is a continuation in part of U.S. patent application Ser. No. 15/828,742, filed on Dec. 1, 2017, which makes reference to, claims priority to, and claims the benefit of U.S. Provisional Patent Application Ser. No. 62/429,575, filed on Dec. 2, 2016, both of which are incorporated herein by reference in their entirety.

TECHNICAL FIELD

The invention relates to a garage door opener system having an intelligent automated assistant, and particularly a garage door opener having the intelligent automated assistant that controls garage door opener accessories in response to voice commands.

SUMMARY

Some embodiments include a garage door opener system including a garage door opener having a motor for moving a garage door, a wireless communication interface, a user communication interface including a microphone, a garage door opener accessory, and a controller. The controller is communicatively coupled to the user communication interface, the wireless communication interface, the garage door opener accessory and the garage door opener motor. The controller includes an electronic processor and a memory storing instructions executable by the electronic processor. The instructions cause the electronic processor to control the garage door opener motor to move the garage door, detect a command from a user via the microphone, and generate a responsive control action to control the garage door opener accessory.

In some embodiments, a method for controlling a garage door opener system includes, in an electronic processor of a garage door opener having a memory, a controller communicatively coupled to a user communication interface including a microphone, a wireless communication interface, a garage door opener accessory and a garage door opener motor, controlling the garage door opener motor to move the garage door, detecting a command from a user via the microphone, and generating a responsive control action to control the garage door opener accessory.

In some embodiments, a garage door opener system includes a garage door opener having a motor for moving a garage door, a wireless communication interface, a user communication interface, a garage door opener accessory, and a controller. The controller is communicatively coupled to the user communication interface, the wireless communication interface, the garage door opener accessory and the garage door opener motor. The controller includes a processor and a memory storing instructions executable by the processor that cause the processor to control the garage door opener motor to move the garage door, detect a command from a user, and generate a responsive control action to control the garage door opener accessory.

In one embodiment, a garage door opener system includes a garage door opener having a motor for moving a garage door, a user interface (e.g., a microphone and a speaker), and a controller coupled to the user interface and the motor. The controller includes a processor and memory. The memory includes instructions executable by the processor to implement an intelligent automated assistant. The intelligent automated assistant can be used to control the garage door opener. The garage door opener system can further include accessories and the intelligent automated assistant can be further used to control the accessories.

In another embodiment, the invention provides a method of controlling the garage door opener system. The method includes monitoring via the user interface a wake-up command from a user, monitoring via the user interface an operation command from a user, and initiating an operation of the garage door opener system in response to the wake-up command and the operation command. The wake-up command can be one or more of a voice command and a gesture command In another embodiment, a garage door opener system comprises a garage door opener having a motor for moving a garage door, a wireless communication interface, a user communication interface including a microphone, a garage door opener accessory, and a controller. The controller is communicatively coupled to the user communication interface, the wireless communication interface, the garage door opener accessory, and the motor. The controller includes an electronic processor and a memory storing instructions executable by the electronic processor. The electronic processor detects a voice command received via the microphone and authenticates the voice command. The electronic processor further generates, in response to authenticating the voice command, a responsive control action to control the garage door opener system according to the voice command.

In another embodiment, a method for controlling a garage door opener system is provided. The method includes detecting, by a controller including an electronic processor in the garage door opener system, a voice command received via a microphone of the garage door opener system. The controller authenticates the voice command and generates, in response to authenticating the voice command, a responsive control action to control the garage door opener system according to the voice command. The garage door opener system includes a garage door opener and a garage door opener accessory.

Other features and aspects of the invention will become apparent by consideration of the following detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. Additionally, as used herein with a list of elements, "and/or" is intended to mean one or a combination of the listed elements. For example, "A, B, and/or C" should be understood to include any of A, B, C, AB, BC, AC, or ABC.

Figure 1:
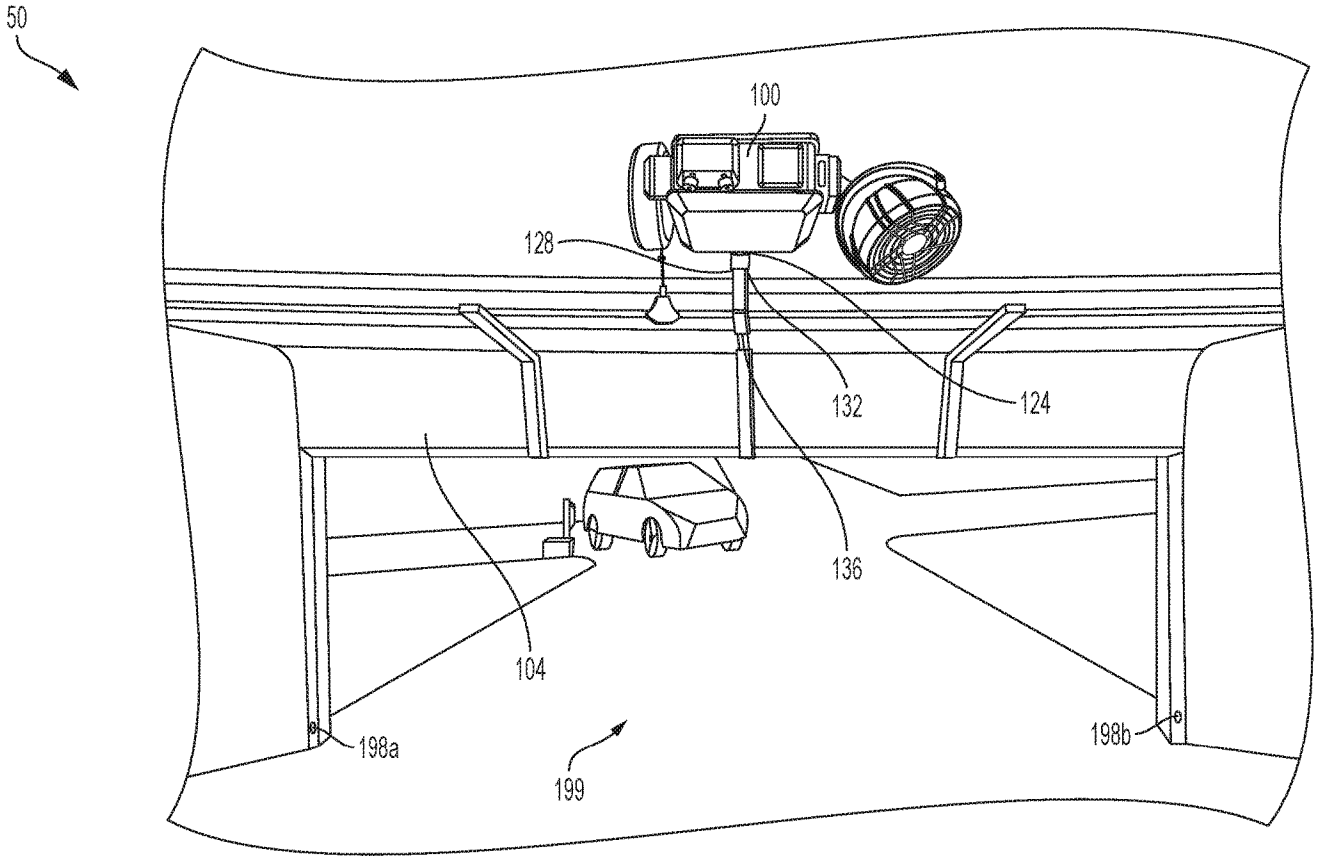
FIG. 1 is a view of a garage door opener system.
Figure 2:
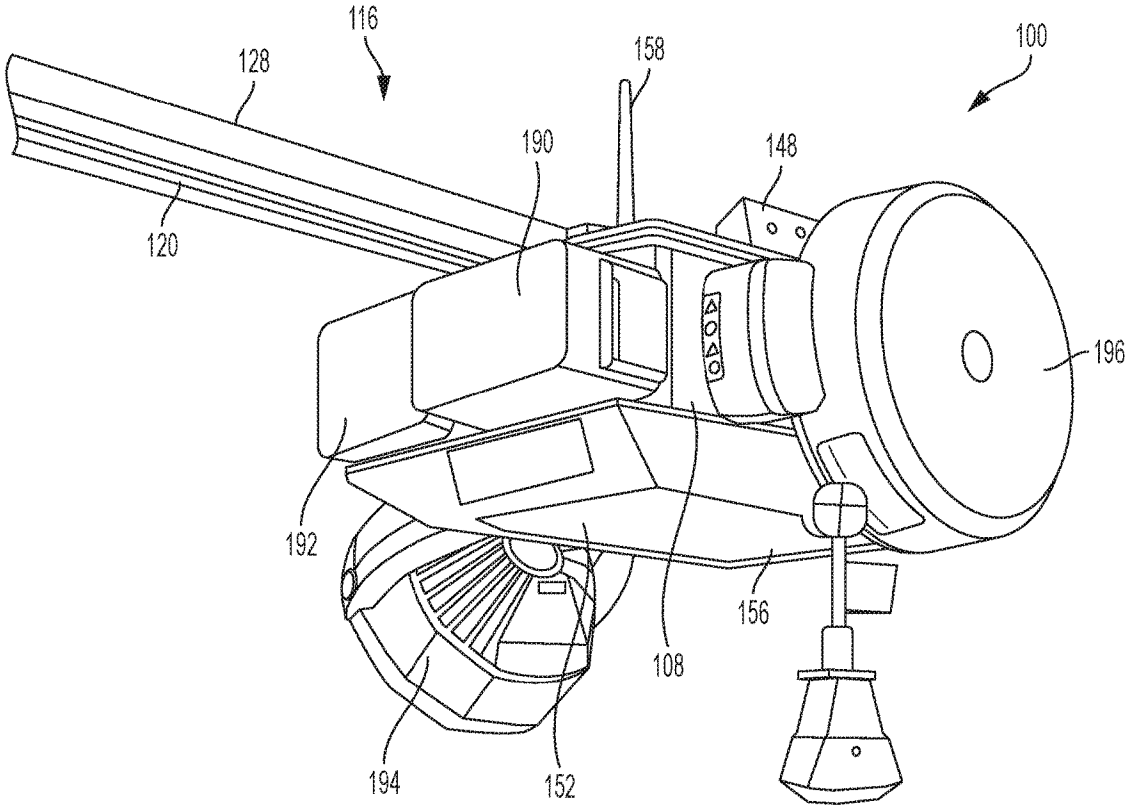
FIG. 2 is a view of a garage door opener of the garage door opener system in FIG. 1.

FIGS. 1-2 illustrate a garage door opener system 50 including a garage door opener 100 operatively coupled to a garage door 104. The garage door opener 100 includes a housing 108 supporting a motor that is operatively coupled to a drive mechanism 116. The drive mechanism 116 includes a transmission coupling the motor to a drive chain 120 having a shuttle 124 configured to be displaced along a rail assembly 128 upon actuation of the motor. The shuttle 124 may be selectively coupled to a trolley 132 that is slidable along the rail assembly 128 and coupled to the garage door 104 via an arm member.

The trolley 132 is releaseably coupled to the shuttle 124 such that the garage door opener system 50 is operable in a powered mode and a manual mode. In the powered mode, the trolley 132 is coupled to the shuttle 124 and the motor is selectively driven in response to actuation by a user (e.g., via a key pad, or wireless remote or smart device in communication with the garage door opener 100). As the motor is driven, the drive chain 120 is driven by the motor along the rail assembly 128 to displace the shuttle 124 (and, therefore, the trolley 132), thereby opening or closing the garage door 104. In the manual mode, the trolley 132 is decoupled from the shuttle 124 such that a user may manually operate the garage door 104 to open or close without resistance from the motor. The drive mechanism 116 can be different for other garage door opener systems 50.

The housing 108 is coupled to the rail assembly 128 and a surface above the garage door (e.g., a garage ceiling or support beam) by, for example, a support bracket 148.

The garage door opener 100 further includes an antenna 158 enabling the garage door opener 100 to communicate wirelessly with other devices.

The garage door opener 100 is also configured to receive information (including control commands) from and/or provide information (including control command) to a variety of accessory devices (or simply accessories). The accessories may be integrated with, connected to, interconnected with, or remote from the garage door opener 100. The accessory devices may include, for example, input accessory devices (or simply input accessories) or output accessory devices (or simply output accessories). An accessory device may also provide dual functions of an input accessory and an output accessory. Example accessories are discussed throughout the document below.

The garage door opener 100 includes a light unit 152 including a light (e.g., one or more light emitting diodes (LEDs)) enclosed by a transparent cover or lens 156. The light unit 152 may either be selectively actuated by a user or automatically powered upon actuation of the garage door opener 100. The light unit 152 is an example of an output accessory integrated with the garage door opener 100.

The garage door opener 100 further includes an obstruction sensor including a transmitter **198*a* that emits an infrared beam and a receiver 198*b* that receives the infrared beam emitted from the transmitter 198*a*. The transmitter 198*a* may be placed on opposite sides of a garage door opening 199, as illustrated in FIG. 1, and used to detect objects (e.g., animals, persons, bicycles) in the path of the garage door. The transmitter 198*a* and the receiver 198*b* may be collectively referred to as an obstruction sensor 198. The obstruction sensor is an example of a remote input accessory electrically connected to the garage door opener 100**.

The garage door opener 100 in FIGS. 1 and 2 shows accessories interconnected with the garage door opener 100. The accessories are directly connectable and removable from the garage door opener 100. The shown interconnected accessories are a backup battery unit 190, a speaker 192, a fan 194, and an extension cord reel 196.

Figure 3A:
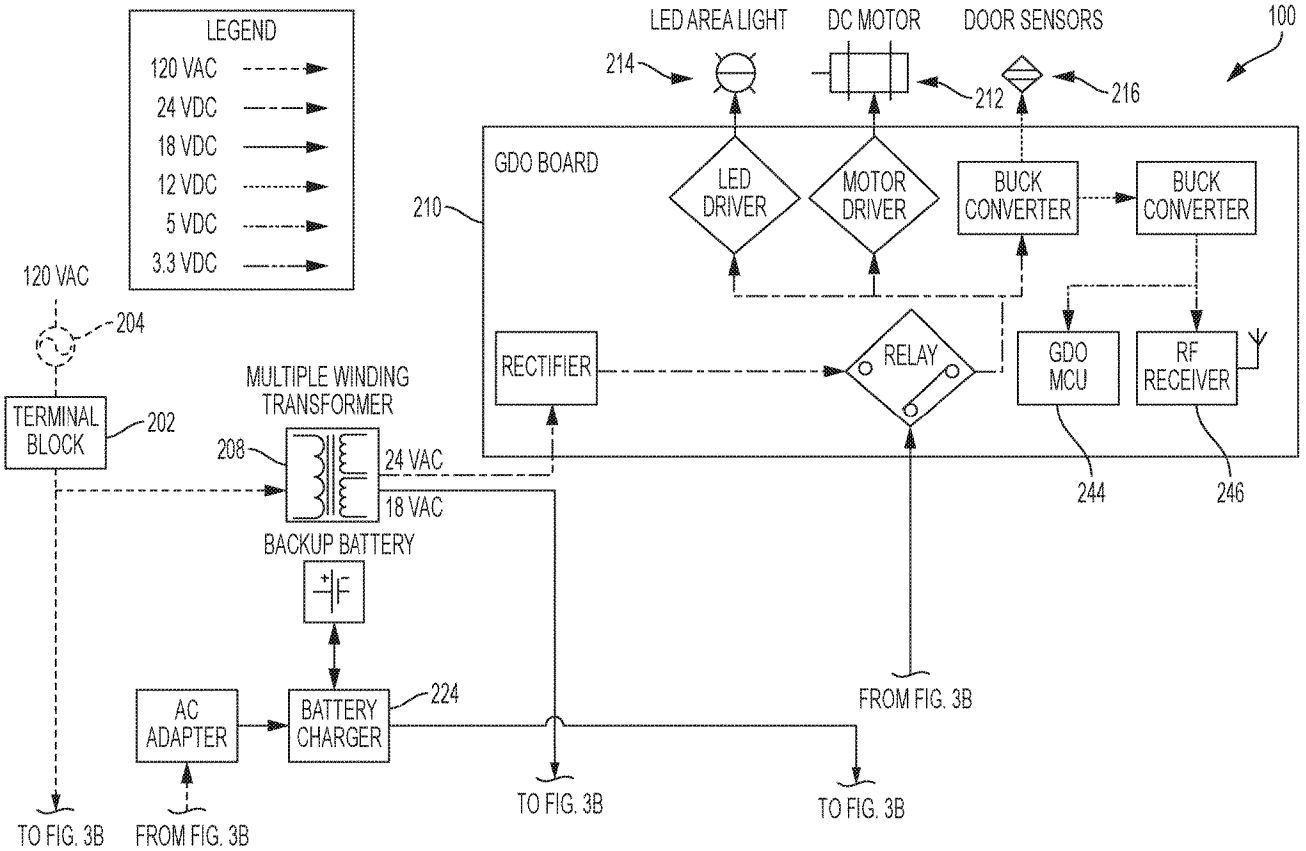
FIGS. 3A-3B illustrate a block power diagram of the garage door opener of FIG. 2.
Figure 3B:
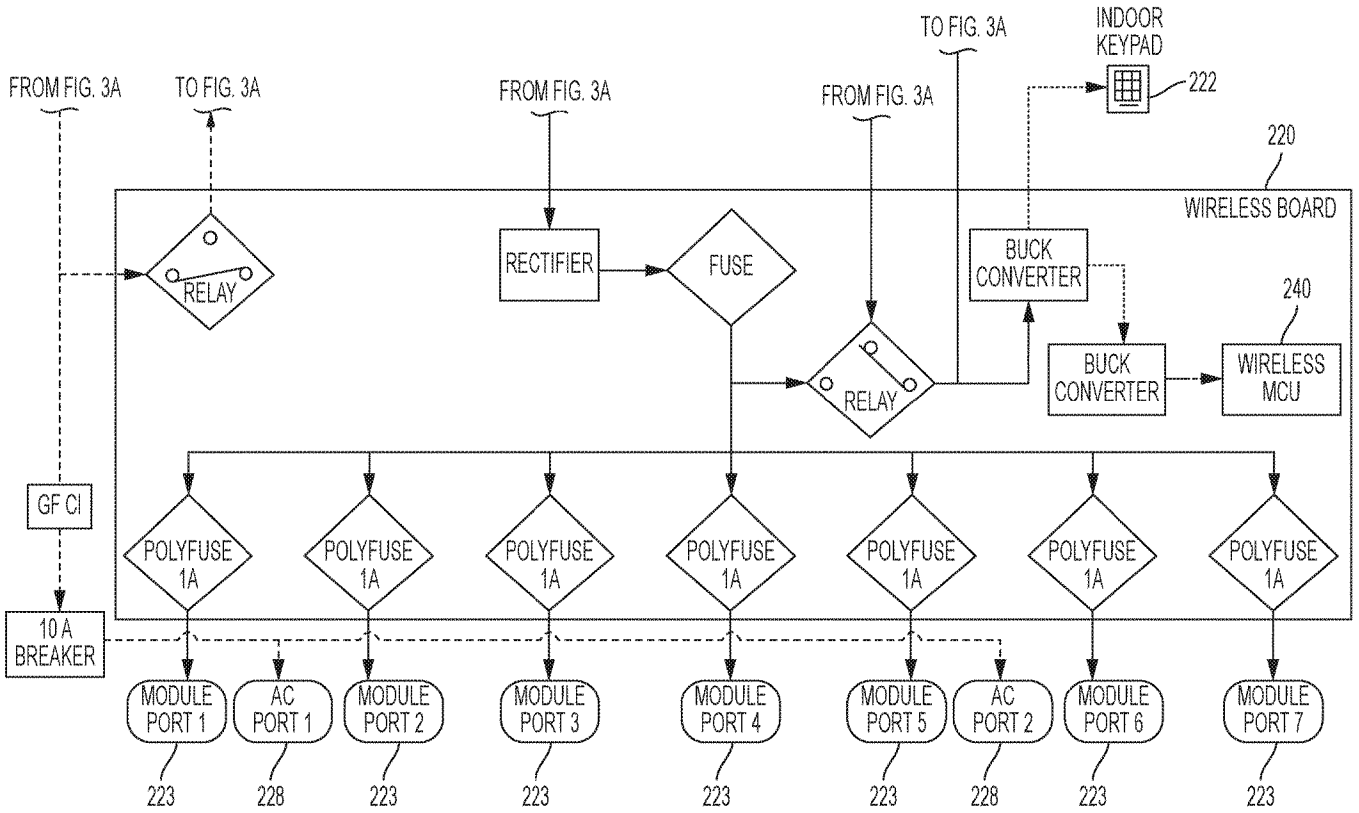

FIGS. 3A and 3B illustrate a block power diagram of the garage door opener 100. The garage door opener 100 includes a terminal block 202 configured to receive power from an external power source 204, such as a standard 120 VAC power outlet. The terminal block 202 directs power, via a transformer 208, to a garage door opener (GDO) board 210 for supply to components thereof as well as a motor 212 (used to drive the drive mechanism 116), LEDs 214 (of the light unit 152), and garage door sensors 216. Examples of garage door sensors 216, which are input accessories, include motion sensors for detecting motion of objects in a space associated with the garage door, position sensors for detecting garage door position, and obstruction sensors for detecting objects in the path of the garage door. The terminal block 202 further directs power via the transformer 208 to a wireless board 220 and components thereof, as well as a wired keypad 222 (an example condition accessory) and module ports 223 The terminal block 202 also directs power to a battery charger 224 and AC ports 228. The module ports 223 are configured to receive various accessory devices, such as a speaker, a fan, an extension cord reel, a parking assist laser, an environmental sensor, a flashlight, and a security camera. One or more of the accessory devices are selectively attachable to and removable from the garage door opener 100, and may be monitored and controlled by the garage door opener 100.

The wireless board 220 includes a wireless microcontroller 240, among other components. The GDO board 210 includes, among other components, a garage door opener (GDO) microcontroller 244 and a radio frequency (RF) receiver 246. The wireless board 220 and the GDO board 210 can be combined as a single board, and the microcontroller 240 and the microcontroller 244 can be combined as a single microcontroller. The terminology, e.g., GDO and wireless, the number of boards, and the number of microcontrollers are exemplary.

The microcontrollers 240 and/or 244 can include processors configured to carry out the functionality described herein attributed thereto via execution of instructions stored on a compute readable medium (e.g. one of the illustrated memories), can include hardware circuits (e.g., an application specific integrated circuit (ASIC) or field programmable gate array) configured to perform the functions, or a combination thereof.

Figure 4:
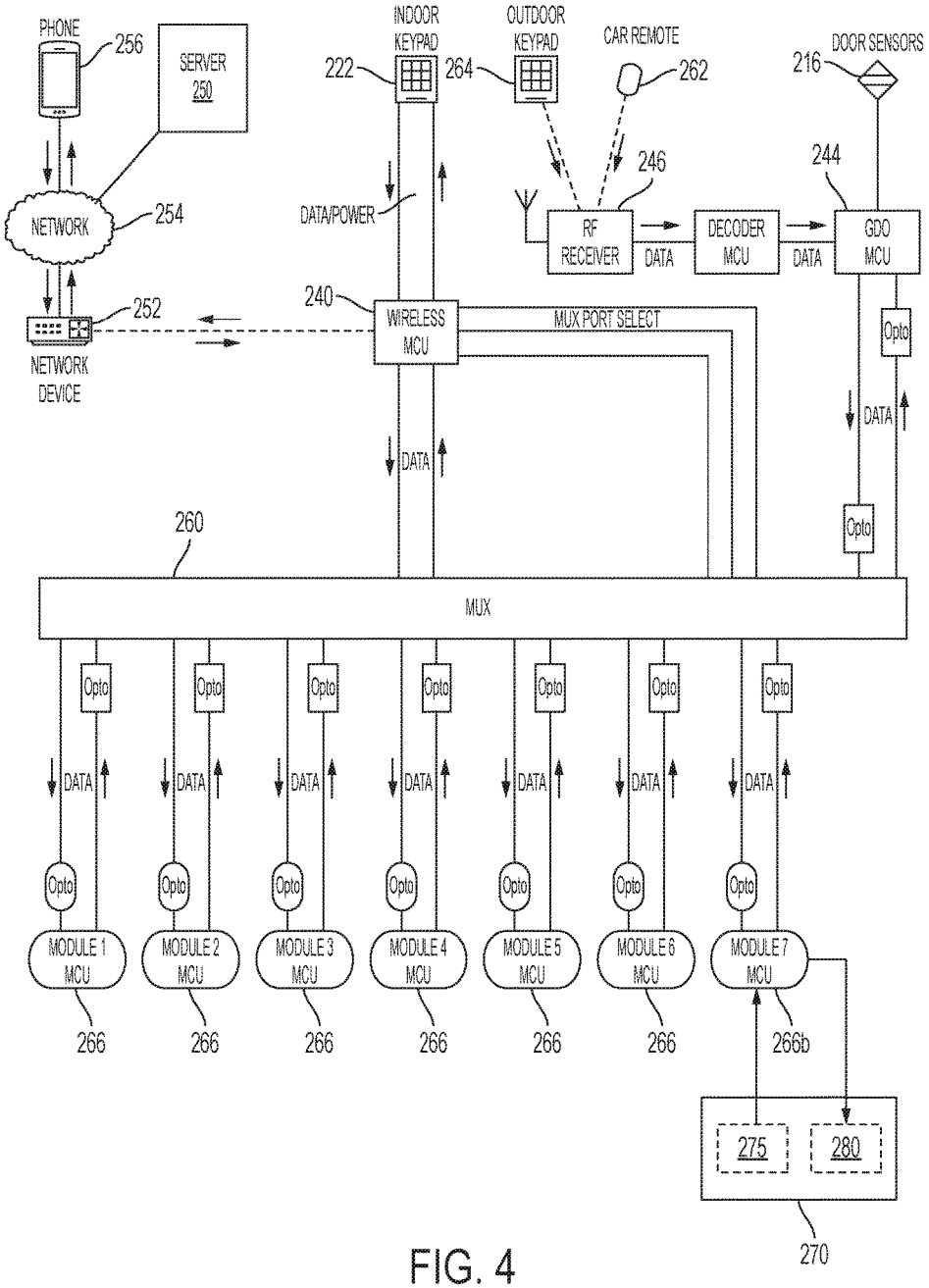
FIG. 4 is a block communication diagram of the garage door opener of FIG. 2.

FIG. 4 illustrates a block communication diagram of the garage door opener 100. The wireless microcontroller 240 is coupled to the antenna 158 and enables wireless communication with a server 250 via a network device 252 and network 254, as well as with a personal wireless device 256, such as a smart phone, tablet, or laptop. The personal wireless device is an example of an accessory device of the garage door opener system 50 that can provide dual functions and is remote from the garage door opener. The network device 252 may be, for example, one or more of a router, hub, or modem. The network 254 may be, for example, the Internet, a local area network (LAN), another wide area network (WAN) or a combination thereof. In other figures, the network device 252 may be considered part of the network 254 for simplicity. The wireless microcontroller 240 may include, for example, a Wi-Fi radio having hardware, software, or a combination thereof enabling wireless communications according to the Wi-Fi protocol. In embodiments, the wireless microcontroller 240 is configured to communicate with the server 250 via the network device 252 and network 254 using other wireless communication protocols. The network 254 may include various wired and wireless connections to communicatively couple the garage door opener 100 to the server 250. As illustrated, the wireless microcontroller 240 also includes wired communication capabilities for communicating with the GDO microcontroller 244 via the multiplexor 260. In some embodiments, the wireless microcontroller 240 and the GDO microcontroller 244 are directly coupled for communication. As already stated for some embodiments, the wireless microcontroller 240 and the GDO microcontroller 244 can be combined into a single controller.

The RF receiver 246 wirelessly communicates to various user actuation devices, including one or more wireless remotes 262 and wireless keypads 264, each of which provide input accessories, to receive and provide to the GDO microcontroller 244 user actuation commands (e.g., to open and close the garage door 104). The personal wireless device 256 may also receive user input and, in response, provide (directly or via the network 254) to the wireless microcontroller 240 user actuation commands for the garage door opener 100 or commands to control one or more of the accessory devices. Similarly, the garage door opener 100 may provide information to the personal wireless device 256. The multiplexor 260 enables communication between and among the wireless microcontroller 240, the GDO microcontroller 244, and the accessory microcontrollers 266 (of the accessory devices previously noted). One of the accessory microcontrollers includes a microcontroller 266B of a user interface 270. The user interface 270 includes a microphone 275 and speaker 280 for interfacing with a user. More specifically, in one implementation, a user can provide voice commands to the garage door opener 100 and receive audible responses from the garage door opener 100. The microphone 275 and the speaker 280 can be directly connected to the wireless MCU 240 and the functionality of the microcontroller 266B can be integrated with the microcontroller of the wireless MCU 240. It is also envisioned that the user interface 270 can be disposed remote from the garage door opener and in communication with the garage door opener 100 either wired or wirelessly.

Figure 5:
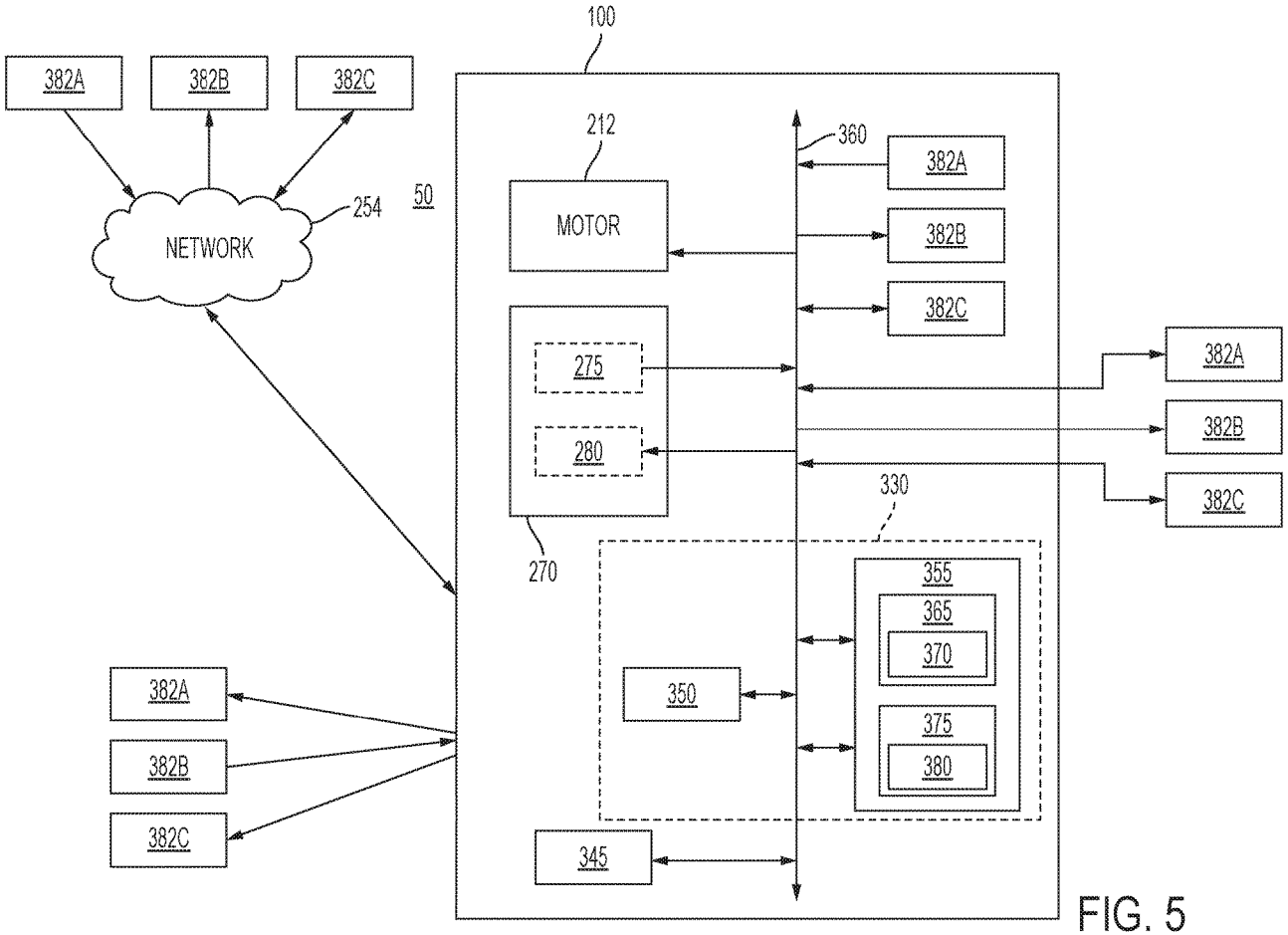
FIG. 5 is a diagram of a garage door system including the garage door opener of FIG. 2.

FIG. 5 illustrates a diagram of select components of a garage door opener system 50 including the garage door opener 100. The garage door opener 100 includes an intelligent automated assistant (IAA) controller 330. Only select components of the IAA controller 330 are illustrated including a processor (e.g., an electronic processor) 350, and a memory 355. The IAA controller 330 may be part of the wireless microcontroller 240 and/or part of the GDO microcontroller 244 (FIG. 4) and/or include its own microcontroller. The processor 350 and memory 355 are in communication with the user interface 270 via a communication bus 360, which may include the multiplexor 260 (FIG. 4). The memory 355 includes a first nonvolatile memory block 365 storing instructions 370 and a second nonvolatile memory block 375 storing operation information 380.

The garage door opener system 50 further includes accessories 382 including input accessories 382A and output accessories 382B. Some accessories (e.g., accessories 382C) can be both input and output; i.e., input/output accessories 382C. Also, some accessories 382 can be located remote from the garage door opener 100 and wired to the garage door opener 100, some accessories can be located remote from the garage door opener 100 and communicate wirelessly to a wireless transceiver 345 of the IAA controller 330 directly, and some accessories 382 can be located remote from the garage door opener 100 and communicate wirelessly to the IAA controller 330 through the network 254. The wireless transceiver 345 may be part of or coupled to the wireless microcontroller 240 within the garage door opener 100. The wireless transceiver 345 may comprise a plurality of transceivers for communication utilizing any wireless technology suitable for communicating with the accessories 382, the personal wireless device 256, the server 250, the network device 252, the network 254, and other user devices. The IAA controller 330 may communicate via the transceiver 345 directly (device to device) with local devices or via the network 254 with remote devices. Wireless technologies supported by the IAA controller 330 and/or transceiver 345 may include, for example, private area network technologies such as Bluetooth, wireless local area network (WLAN) technologies such as WiFi, and wide area network technologies such as cellular or low power long range (LoRa) or low power wide area network (LPWAN) technologies. In some embodiments, the IAA controller 330 and the transceiver 345 communicate utilizing LoRa or LPWAN technologies with data rates that range from 0.3 kbps to 50 kbps and/or an adaptive data rate (ADR) scheme to manage data rate and RF outputs.

One example of an input accessory 382A is the obstruction sensor 198 of FIG. 1. The obstruction sensor 198 may be configured to output a first signal to the processor 350 when the beam from the transmitter 198*a* is received by the receiver 198*b* and not obstructed (e.g., by an object), and to output a second signal to the processor 350 when the beam is obstructed.

Another example of an input accessory 382A is one or more condition sensing components configured to sense a condition associated with the garage door opener 100 or an associated space thereof, and output an indication of the sensed condition to the garage door opener 100. In some embodiments, the condition sensing component is hardwired to or integrated into the garage door opener 100. The condition sensing component may include one or more motion sensors for detecting motion of objects in a space associated with the garage door opener 100, position sensors for detecting a position of the garage door 104, door sensors for detecting a position (e.g., open or closed) of a hinged door or lid (independent of the garage door 104), or a combination thereof. Each motion sensor provides an indication to garage opener 100 upon detecting motion in a sensing region covered by the motion sensor. The space associated with a garage door opener 100 in which the motion sensors detect motion may be, for example, an area within the garage in which the garage door opener 100 is located or an area within infrared line-of-sight of the garage in which the garage door opener 100 is located. In other words, in some embodiments, the motion sensors may be attached to the garage in which the garage door opener 100 is located, on an internal portion of the garage or on an external portion of the garage. The motion sensors may also be separately located from the garage such that they are within range to communicate wirelessly via the wireless transceiver 345, or via a wired connection with the garage door opener 100, and can detect motion in a space associated with the garage door opener 100. For example, a motion sensor may be placed along a driveway, a walkway, a doorway, or other spaces associated with the garage door opener 100. In this regard, the space associated with the garage door opener 100 includes a path associated with the garage, such as along the driveway. In some embodiments, multiple motion sensors are aimed at different spaces associated with the garage door opener 100, and the garage door opener 100 is, therefore, configured to determine whether motion is occurring in any of multiple different spaces associated with the garage door opener 100. One or more of the motion sensors can determine when motion occurs in the spaces associated with the garage door opener 100. The processor 350 may record detected motion and/or send a security report regarding the detected motion to the server 250 or to a user, for example, to the personal wireless device 256 or another user device via the network 254.

Another example of accessories 382 includes one or more devices that are located remotely from the garage door opener 100, for example, driveway gates and alarms, mailbox alarms, and remote motion detectors. These remote accessories 382 may be equipped to communicate wirelessly with the IAA controller 330 or with other accessories 382 directly utilizing LoRa, LPWAN, or another wireless technology. The remote devices may communicate user commands, accessory device information or requests, alarms, or detected motion to the IAA controller 330 via the transceiver 345 or to another accessory. The IAA controller 330 or the other accessories 382 may communicate wirelessly utilizing LoRa, LPWAN, or another wireless technology to control the remotely located devices based on user commands received by the IAA controller 330 or accessory device communications. Indoor or outdoor areas or objects serviced by the remote accessories 382 may be referred to as the areas associated with garage door opener 100.

In some embodiments, the position sensors for detecting a position of the garage door 104 include an optical sensor aimed at the garage door 104 that outputs data to the processor 350 indicative of the position and movement of the garage door 104. In some embodiments, the position sensors are configured to track movement of the motor 212 or another component mechanically coupled to the garage door 104, and to output data indicative of the position and movement of the garage door 104. Based on the output data of the one or more position sensors, the processor 350 is operable to determine the position of the garage door 104.

In some embodiments, the door sensors detect whether a hinged door (e.g., providing access for individuals to the garage in which the garage door opener 100 is located) is open or closed. In some embodiments, the door sensors detect whether a hinged lid or door of a safe, cabinet, trunk, or the like, is open or closed. The door sensors provide an indication of whether the hinged door is open or closed to the processor 350. Each of the condition sensing components, in addition to the indicators provided to the processor 350, may provide an identifier to the processor 350 such that the processor 350 is operable to determine which of the condition sensing components is providing the indication.

One example of an output accessory 382B is a lock for the garage door, a hinged lid, or an entry door. In some embodiments, the garage door opener 100 can send an output to the lock for locking or unlocking the lid or door. In some embodiments, the garage door opener 100 can send an output to the lock for locking or unlocking the lid or door. In addition to door sensors and locks, similar accessories are provided for locking or unlocking one or more windows.

Another example of an output accessory 382B is a tracker device. The tracker device can include visual and/or audible output for communication with a user. For example, the tracker device can provide an audible beep and/or illumination in response to a commanded stimulus from the garage door opener 100.

While only a finite number of accessories 382 are illustrated in FIG. 5, the garage door opener system 50 may include many more accessories and is only limited based on the systems capabilities. Additionally, as can be appreciated based on the below description, a particular accessory device 382 of the garage door opener 100 may, in a first moment in time, be considered an input accessory 382A and, in a second moment in time, be an output accessory 382B, or dual input/output accessory 382C.

Figure 6:
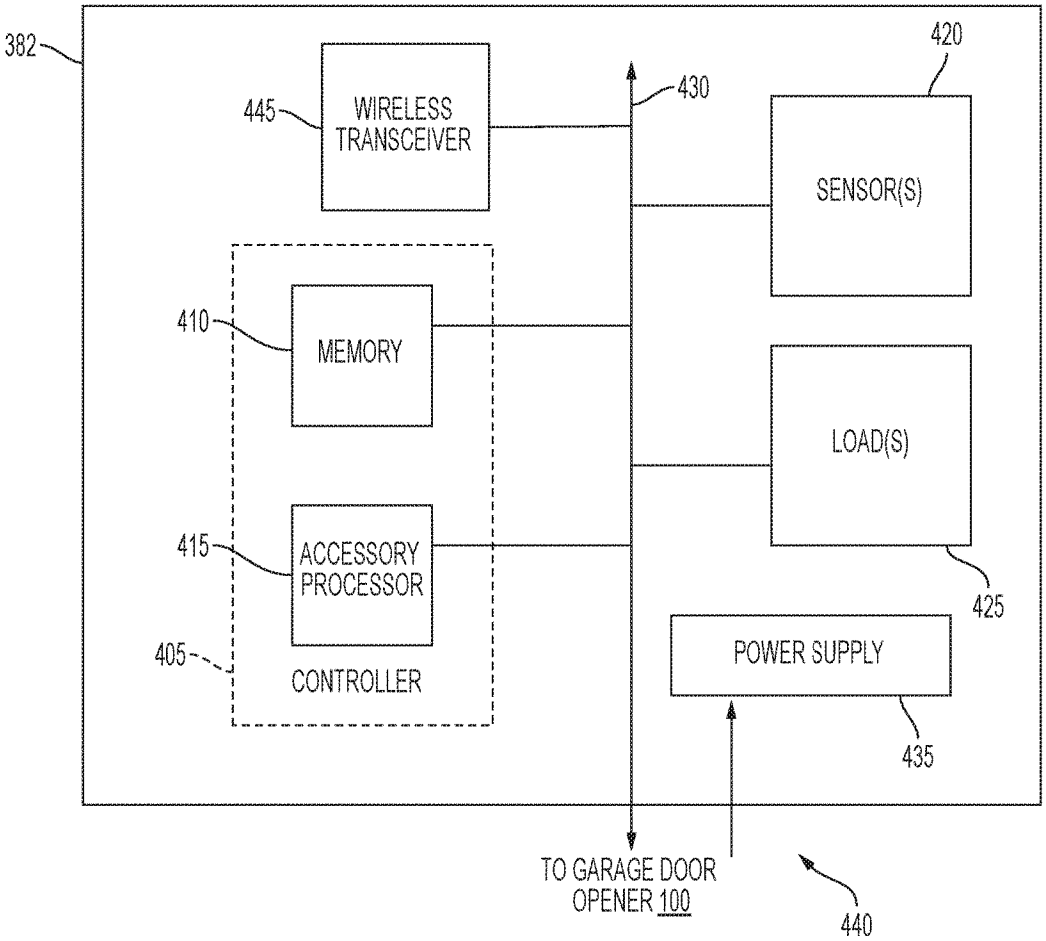
FIG. 6 is a diagram of an accessory device operable with the garage door system of FIG. 5.

FIG. 6 illustrates a block diagram of the accessory (e.g., an electronic accessory) 382. The block diagram is applicable to each of the types of accessories 382A-C. As illustrated, the accessory 382 includes a controller 405 having a memory 410 and an accessory processor (e.g., an electronic accessory processor) 415, one or more sensors 420, and one or more loads 425 coupled by a bus 430. The accessory 382 further includes a power supply 435 that conditions and filters input power, and provides the power to the other components of the accessory 382. The controller 405 executes software, which may be stored in memory 410, to carry out the functions of the accessory 382 described herein. The particular sensors 420, loads 425, and functions of the controller 405 vary depending on the type of accessory 382. For example, in some embodiments, the accessory 382 does not include one of the sensors 420; and, in other embodiments, the accessory 382 does not include one of the loads 425. The controller 405 may be, for example, the microcontroller 266 for each accessory noted above with respect to FIG. 4.

The accessory 382 is coupled to the garage door opener 100 via an interface 440 to enable data communications between the controller 405 and the garage door opener 100 and to provide power to the accessory 382 from the garage door opener 100. In some embodiments, the accessory 382 is selectively attachable to and removable from the garage door opener 100. In such embodiments, the interface 440 includes an electro-mechanical connector enabling the physical mounting of the accessory 382 to the garage door opener 100 and an electrical connection for power and data transmission between the accessory 382 and the garage door opener 100.

In some embodiments, the accessory 382 is wirelessly connected to and physically disconnected from the garage door opener 100. In such instances, the accessory 382 includes a wireless transceiver 445 for communicating with the garage door opener 100, and the power supply 435 includes a separate power source (e.g., a replaceable battery, photovoltaic cells, and the like). Accordingly, the interface 440 includes a wireless connection for communication (e.g., between the wireless transceiver 445 and the wireless transceiver 345 (FIG. 5)), and is without a physical communication connection and power connection to the garage door opener 100. In some embodiments, the accessory 382 includes the wireless transceiver 445 for communicating with the garage door opener 100 and a physical power connection to the garage door opener 100, but is without a physical communication connection. In further embodiments, the accessory 382 does not include the wireless transceiver 445 and, rather, uses a physical communication connection and power connection of the interface 440.

Figure 7A:
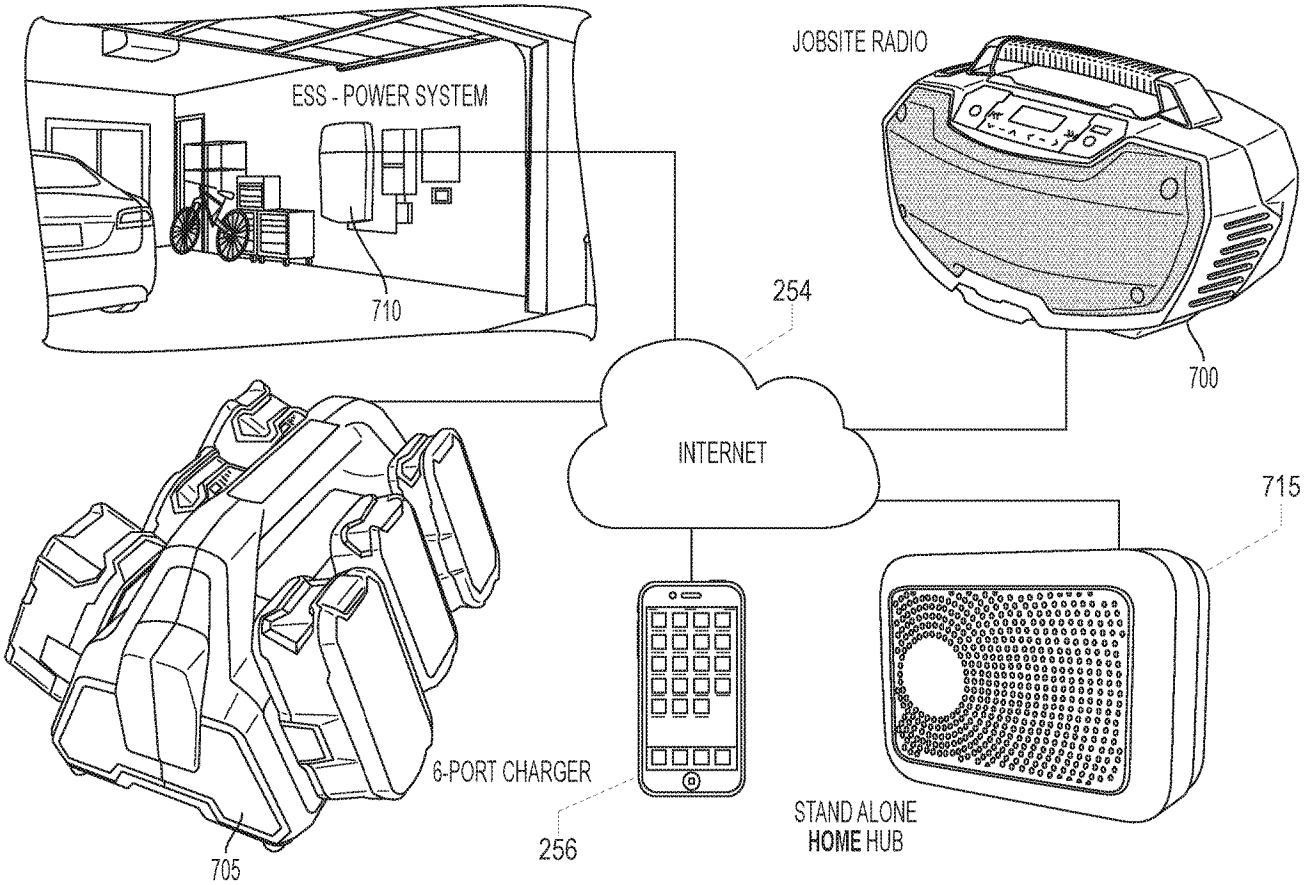
FIG. 7A is a view of a garage door opener system.

In certain embodiments, the garage door opener 100 includes an intelligent automated assistant (IAA) supported by the IAA controller 330. For example, in one embodiment, the memory 355 stores IAA software instructions that are retrieved and executed by the processor 350 to implement the IAA. The user interface 270, which was described in one embodiment as including a microphone 275 and speaker 280, can include an alternative input such as a keyboard, touchscreen, mouse, touch pad, trackball, joystick, motion sensors, and combinations thereof and an alternative output such as a screen, display, or printer. In some embodiments, the IAA is located in other accessory devices in communication with the garage door opener 100, or even standalone components, such as a jobsite radio 700, a battery charger 705, an energy storage system 710, and a standalone home hub 715, examples of which are shown in FIG. 7A. Each standalone component includes, in addition to elements typical of each type of device (e.g., for the jobsite radio 700, a radio tuner, radio and volume settings buttons, and a power source, among other elements), one or more of the IAA controller 330, the user interface 270, and the wireless transceiver 345, and may also be coupled to one or more of the accessory devices 382A-C.

Figure 7B:
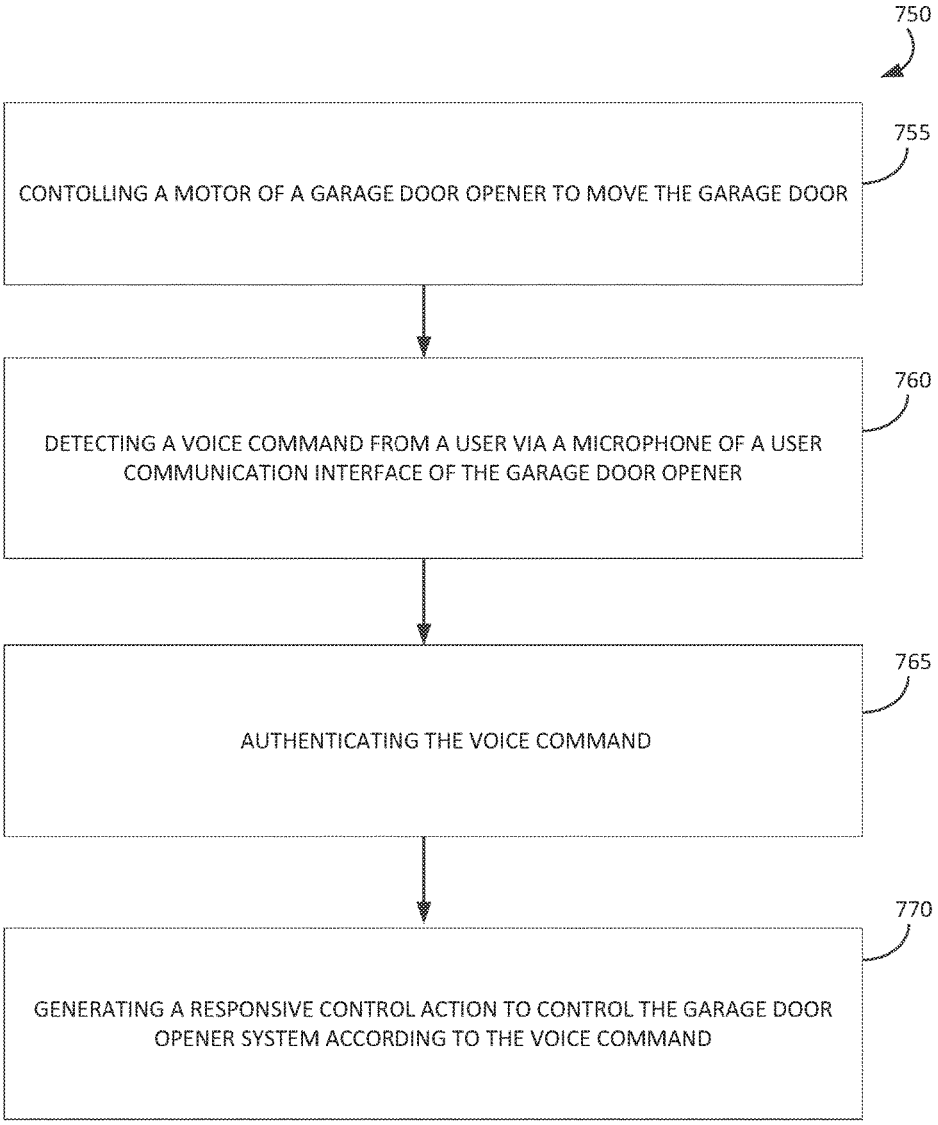
FIGS. 7B-7C are flowcharts for controlling a garage door opener system having an intelligent automated assistant controller.

FIG. 7B illustrates a flowchart 750 for controlling the garage door opener system 50 having the IAA controller 330. In step 755, the IAA controller 330 comprising the processor 350 (i.e., an electronic processor of the garage door opener 100) controls the motor 212 of the garage door opener 100 to move the garage door 104. For example, a user may enter a command to open or close the garage door. The command may be entered via an indoor or outdoor keypad (e.g., the keypads 222, 264), a car remote control (e.g., the car remote 262), a microphone as a voice command (e.g., the microphone 275), an accessory 382, or a wireless remote or smart device (e.g., phone 256) in communication with the garage door opener 100. The IAA controller 330 may receive and interpret the garage door open or close command and activate the motor 212 to open or close the garage door as described further with respect to FIGS. 1-2.

In step 760, the processor 350 detects a voice command received from a user via the microphone 275 of the user communication interface 270 of the garage door opener 100 or of an accessory 382, for example. For example, voice received by the microphone 275 is converted to audio data. The audio data includes a command or request to activate one or more of the accessories 382 or control a function of the garage door opener 100. The processor 350 may have voice recognition software to identify commands in the audio data, or may send the audio data via the wireless transceiver 345 and the network 254 to a server that executes voice recognition software, in which case, the server returns command identifiers to the processor 350. The voice recognition software may be referred to as speech recognition software. In one embodiment, the voice recognition software of the garage door opener 100 may compare the captured audio data, in whole or parsed into segments, to stored audio data of known voice commands to identify a match, or the processor 350 may be operable to use other methods of voice recognition such as natural language recognition techniques. In some embodiments, the server may have more advanced voice recognition software than the garage door opener 100, and the processor 350 may forward audio data to the server when it is not able to recognize a command in the audio data. For example, the server may utilize grammar based or natural language recognition to interpret the captured audio data and may recognize one or more commands for the processor 350. The server may respond to the processor 350 with an identified voice command recognized from the audio data.

In some embodiments, the IAA controller 330 may send the audio data to the personal wireless device 256 or another user device for speech recognition services to detect speech commands in the audio data. The IAA controller 330 and the personal wireless device 256 may communicate via the transceiver 345 and any suitable wireless network technology, for example, a wide area network such as a cellular network, a personal area connection such as a Bluetooth connection, or a wireless local area network, for example, a Wi-Fi network. The personal wireless device 256 may include voice recognition software that is operable to receive the audio data from the IAA controller 330 and recognize voice commands based on the audio data. The personal wireless device 256 may return command identifiers to the IAA controller 330 for controlling the accessories 382 and other components of the garage door opener system 50. Alternatively, in some embodiments, the personal wireless device 256 may receive the user voice commands as spoken directly from the user and may either recognize the voice commands and send command identifiers to the IAA controller 330, or send audio data to the IAA controller 330 for voice recognition by the processor 350. The processor 350 receives the command identifiers from an external device or determines the command identifiers based on voice recognition of the audio data.

In step 765, the IAA controller 330 authenticates a voice command. Various techniques implemented by the IAA controller 330 to authenticate a voice command in step 765 are described below with respect to the flowchart of FIG. 7C, and may include one or more of voice authentication, user position authentication, and user device position authentication.

In FIG. 7B, the voice authentication step 765 is illustrated as occurring after the voice command detection step 760. However, in some embodiments, steps 765 and 760 are executed in parallel or partially in parallel, rather than serially. For example, the same audio data obtained by the garage door opener may be analyzed to both authenticate a user (via voice authentication) (step 765) and may include the voice commands detected by the garage door opener (step 760). In some embodiments, the voice authentication (step 765) occurs before the voice command is detected (step 76), thereby pre-authenticating the voice command. In step 770, in response to authenticating the voice command, the processor 350 generates a responsive control action to control the garage door opener system according to the voice command. The responsive control action one or more of controls the motor 212 to open the garage door, controls the motor 212 to close the garage door, and controls a garage door opener accessory. (i.e., one of the accessory devices 382A-C) of the garage door opener to implement the voice command. In the case of the responsive control action controlling an accessory, the voice command may identify one or more of the accessories 382 and a control action for the accessory 382. The memory 380 may include a table that maps voice commands to control instructions to implement the responsive control action. The control instructions may be referred to as an accessory command and may comprise data or code that indicates steps for the accessory 382 to take, for example, activate a load 425 or read a sensor 420. The accessory commands may be wirelessly transmitted to an accessory 382 via the transceivers 345 and 445, and software executed by the accessory processor 415 within the accessory 382 may identify the accessory command and carry out any instructions identified within the accessory command. In some embodiments, the accessory command may indicate to the accessory processor 415 to activate a load 425 in the accessory, for example, open a lock, or turn on a radio.

In some embodiments, the responsive action includes the processor 350 reading or retrieving information, and then conveying the received information to respond to the voice command. For example, the voice command may have requested a battery charge level of a power tool battery (an example accessory). The processor 350 may wirelessly send an accessory command to the power tool battery, via the wireless transceivers 345 and 445, to read the battery charge level from the sensor 420 or memory 410, and report the charge level in an audible notification via a speaker load 425 in the power tool battery. Alternatively, the processor 350 may wirelessly request the battery charge level information from the power tool accessory 382. The power tool accessory 382 may read the battery charge level from the sensor 420 or memory 410 and wirelessly transmit the charge level to the garage door opener 100 via the transceivers 445 and 345. The processor 350 may then respond to the user by sending an audible notification of the power tool battery charge level via a speaker of the garage door opener 100, or by sending a message to the user's wireless device via the wireless transceiver 345 and the network 254.

In some embodiments, the voice command in step 760 is an operational command received when the processor 350 is in an operational command listening mode, which was entered because of a previously received wake-up command. More particularly, a user may initiate the IAA through a wake-up command, such as an initial verbal input or gesture input. The wake-up command can be detected by the user interface 270, such as by the microphone 275 or motion sensors 280. An example verbal wake-up command may be "hey system." Example operational commands include the example user commands discussed above.

In response to detecting the wake-up command, the processor 350 enters into the operational command listening mode. The processor 350 may remain in the operational command listening mode for the shorter of a predetermined length of time (a listening time period) and the detection of an operational command. In the operational command listening mode, the user can then provide more focused operation command(s) to the garage door opener system 50 using the user interface 270. With the operational command, the user can cause the processor 350 to control a particular output accessory 382B or input-output accessory 382C to perform an output function, as described above.

The wake-up command can be combined with various operational commands. For example, the user may command a particular light of the garage door opener system 50 to illuminate through a voice command (e.g., "hey system, turn on garage light to 75% brightness"). As another example command, a user can verbally instruct the garage door to open (e.g., "hey system, open garage door"). Yet alternatively, a user can locate an accessory 382, such as a battery or a small tracker device, via a voice command (e.g., "hey system, find holiday lights"). The command can cause the battery or the small tracker to provide audible (beep) or visual (light flashing) clues, for example, to indicate its location.

Figure 7C:
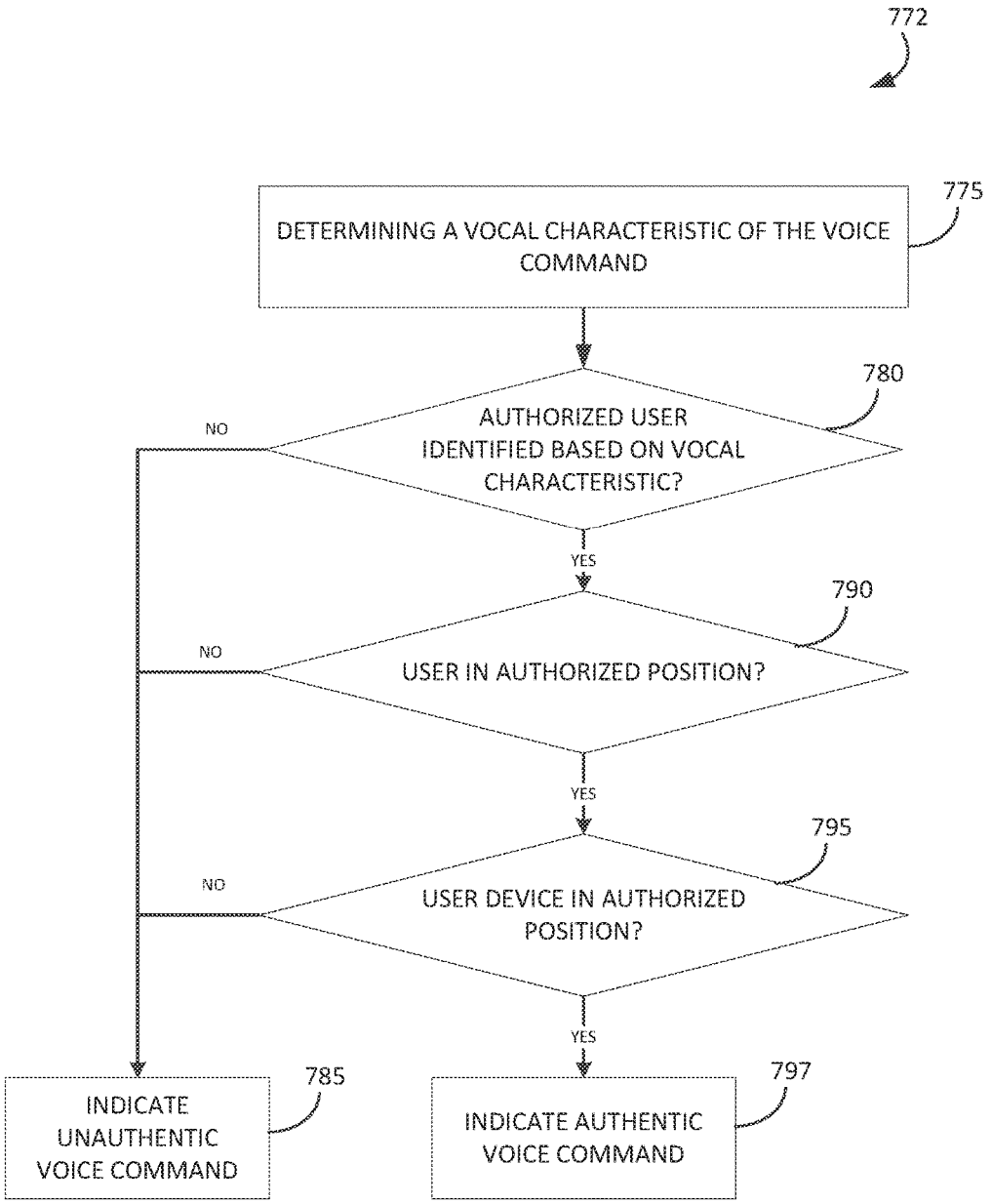

FIG. 7C illustrates a flowchart 772 for authenticating voice commands received by the garage door opener system 50 having the IAA controller 330. In some embodiments, the flowchart 772 is executed to implement the voice command authentication step 765 of the flowchart 750 in FIG. 7B.

In step 775, the IAA controller 330 determines a vocal characteristic of the voice command. For example, the IAA controller 330 may execute voice recognition software to analyze the audio data including the voice command to determine one or more vocal characteristics, such as pitch, frequency, spectral features, and the like.

In step 780, the IAA controller 330 determines whether an authorized user of the garage door opener system provided the voice command based on the vocal characteristic. For example, the memory 355 may store audio verification data including vocal characteristics of voiceprints or voice samples of user's that are authorized to use one or more features or accessories 382 of the garage door opener system 50. The stored audio data may include analog or digital data. This audio verification data may be stored during a setup or installation phase, in advance of the remaining steps of the flowchart 772.

The IAA controller 330 compares the vocal characteristics obtained in step 775 to the audio verification data. When the compared vocal characteristic matches the audio verification data, the voice command is deemed to have come from an authorized user. When the compared vocal characteristic does not match (mismatches) the audio verification data, the IAA controller 330 indicates that the voice command came from an unauthorized user (step 785). Various known voice recognition software may be executed by the IAA controller 330 to implement the vocal characteristic determination of step 775 and the authorized user identification of step 780.

In step 790, the IAA controller 330 determines whether a user is in an authorized position. More particularly, in some embodiments, the one or more motion sensor accessories 382 determine when motion occurs in an authorized position. For example, in some embodiments, the IAA controller 330 considers a user in an authorized position when the user is within the garage, and considers a user in an unauthorized position when the user is outside of the garage. The IAA controller 330 then determines that a user is in an authorized position based on data from a motion sensor indicating motion being sensed within the garage (e.g., at the time of the voice command being received in step 760). In contrast, when the IAA controller 330 does not sense motion within the garage, the IAA controller 330 will determine that the user is not in an authorized position, and indicates that the voice command came from an unauthorized user (step 785).

In step 795, the IAA controller 330 determines whether a portable user device is in an authorized position. Example portable user devices include smart phones, laptops, fob keys, and other wireless communication-enabled portable electronic devices. For example, in some embodiments, the IAA controller 330 considers a portable user device in an authorized position when the portable user device is within a certain distance of the garage door opener 50, and considers a portable user device in an unauthorized position when the portable user device is outside of the certain distance. For purposes of the discussion of FIG. 7C, the personal wireless device 256 will be used as an example of the portable user device.

To determine whether the personal wireless device 256 is in the authorized position, the IAA controller 330 may use one or more techniques. In a first example, the personal wireless device 256 includes a geolocation application and a global navigation satellite system (GNSS) receiver, or may have other device and/or network based location capabilities, to determine the location of the personal wireless device 256. An application executing on the personal wireless device 256 may send a message over the network 254 or via direct wireless communication to the IAA controller 330 when the personal wireless device 256 determines that it is within a specified area of the garage door opener system 50, which may be pre-stored on the personal wireless device 256 during a setup stage. Once the message is received, the IAA controller 330 determines that the personal wireless device 256 is in the authorized position (and proceeds to step 797). When the message has not been received for a predetermined amount of time, or when the personal wireless device 256 provides an updated message indicating that the personal wireless device 256 is no longer within the specified area, the IAA controller 330 determines that the personal wireless device 256 is not in an unauthorized position (and proceeds to step 785).

In some embodiments, the application executing on the personal wireless device 256 may send a message to the IAA controller 330 in response to a request from the IAA controller 330. The request may be sent via direct wireless communication or over the network 254, and may be triggered based on detection of a voice command (in step 760) or detection of motion via one of the motion sensing accessories 382. The message to the IAA controller 330 may include the position of the personal wireless device 256 as determined by the geolocation application and a global navigation satellite system (GNSS) of the personal wireless service 256. Then, the IAA controller 330 compares the received position to the pre-specified authorized area. When the personal wireless device is determined by the IAA controller 330 to be within the pre-specified authorized area, the IAA controller 330 determines that the personal wireless device 256 is in the authorized position (and proceeds to step 797). When the personal wireless device is determined by the IAA controller 330 to be outside the pre-specified authorized area, the IAA controller 330 determines that the personal wireless device 256 is not in an unauthorized position (and proceeds to step 785).

In some embodiments, the application executing on the personal wireless device 256 may send a message to the IAA controller 330 in response to a request from the IAA controller 330 or may periodically broadcast an identification message for receipt by the IAA controller 330. The request may be sent via direct wireless communication or over the network 254, and may be triggered based on detection of a voice command (in step 760) or detection of motion via one of the motion sensing accessories 382. Upon receipt of the message, the IAA controller 330 determines a strength of signal and compares the strength of signal to a strength threshold. When the strength of signal is determined to be above the strength threshold, the IAA controller 330 determines that the personal wireless device 256 is nearby and, thus, in the authorized position (and proceeds to step 797). When the strength of signal is determined to be above the strength threshold, the IAA controller 330 determines that the personal wireless device 256 is not nearby and, thus, in an unauthorized position (and proceeds to step 785).

As noted, in step 785, the IAA controller 330 indicates that the voice command detected in step 760 (of FIG. 7B) came from an unauthorized user and the voice command is not authenticated. Returning momentarily to FIG. 7B, when the voice command detected in step 760 is not authenticated (as determined in step 785 of FIG. 7C), step 765 is not completed and the responsive action of step 770 is not executed. In this scenario, the IAA controller 330 may provide a visual or audible indication that authentication of the voice command failed. In contrast, in step 797 (FIG. 7C), the IAA controller 330 indicates that the voice command is authentic. Returning momentarily to FIG. 7B again, when the voice command detected in step 760 is indicated as authentic (as determined in step 797 of FIG. 7C), step 765 is completed and the responsive action of step 770 is executed.

In some embodiments, only a portion of the flowchart 772 of FIG. 7C is executed to implement the user authentication step 765 of FIG. 7B. For example, in some embodiments, steps 790 and 795 are bypassed such that, upon identifying an authorized user based on vocal characteristic in step 780, the IAA controller 330 proceeds to step 797. Similarly, in some embodiments, just step 790 is bypassed or just step 795 is bypassed. Further, in some embodiments, steps 775 and 780 are bypassed such that the IAA controller 330 starts in step 790 of the flowchart 772. Further, in some embodiments, the order of authorization steps 775, 780, 790, and 795 are changed or some of the authorization steps are performed in parallel or partially in parallel. In summary, any combination or order of the three authorizations performed in the flowchart 772 (voice authorization, user position authorization, user device authorization) are used in various embodiments.

Further, in some embodiments, additional or alternative authorizations are performed to authenticate the voice command in step 760 of FIG. 7B. For example, other biometric data may be entered by a user and authenticated by the IAA controller 330 to authenticate a voice command, such as by using a finger print scanner, facial recognition software with a camera, an eye scanner, and the like.

In some embodiments, the memory 355 stores user permissions to indicate which elements or accessories 382 of the garage door opener system 50 that a user may access or control. For example, the IAA controller 330 may allow a user to control the garage door 104 but not a cabinet lock accessory 382 based on permissions stored for that user. The IAA controller 330 may retrieve user permissions during the voice command authentication step 760. For example, the IAA controller 330 may determine an identity of the user inputting a voice command based on the vocal characteristics of the user or based on information from an authorized portable user device, and the identity of the user then may be used to access the associated permissions for that user in the memory 355.

Figure 8:
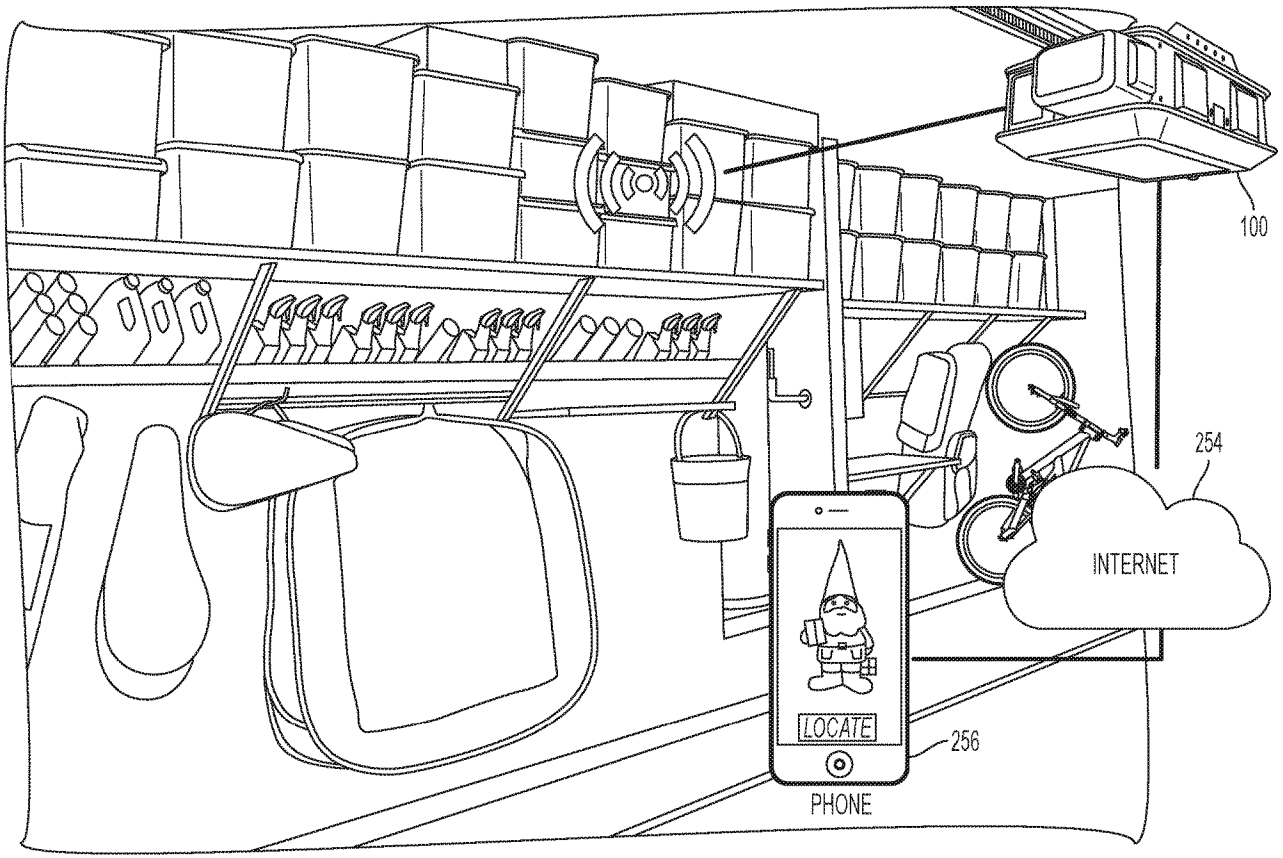
FIG. 8 shows using a personal wireless device communicating with the garage door opener of FIG. 2 to locate a tracker.

FIG. 8 shows an example of a user communicating with the personal wireless device 256 to locate an accessory 382, in the form of the small tracker device, via the IAA of the garage door opener 100. The personal wireless device 256 may receive the user command via a GUI or voice input, for example, and communicate the user command to the garage door opener 100 via the network 254, or directly via a wireless link with the transceiver 345, such as a Bluetooth connection. As described above in step 765, the processor 350 of the garage door opener 100 may identify the user command and determine an accessory command to wirelessly communicate to the small tracker device, for example, via the transceivers 345 and 445. The small tracker device may receive the accessory command comprising data or code that indicates an action, and determine that the command indicates that an audible or visual alert be communicated via a speaker load 425 or a light load 425. The audible or visual alert by the tracker device may indicate to the user the location of an object to be found that may be located near or attached to the small tracker device. In another embodiment, the user command to locate the tracker device is provided via the microphone 275 to the garage door opener 100 and interpreted by voice recognition software as noted above with respect to step 765.

In another embodiment, the processor 330 issues a command to cause the accessory 382, in the form of a lock, e.g., of a tool box, paint cabinet, or door, to lock or unlock (e.g., "hey system, unlock paint cabinet" or "hey system, lock back door"). The locking accessory 382 may comprise a load 425 that may be a solenoid that controls a locking element of the lock in response to the command from the processor 330. The locking accessory 382 may receive and identify the command, and provide power from the power supply 435 to actuate the solenoid load 425 to engage or disengage a locking mechanism in accessory 382.

In some embodiments, push commands are provided to the user through the IAA. The garage door opener 100, via the speaker 192 or 280, can provide notification to the user when a door or winding is opened as detected by a contact sensor (e.g., a sensor 420 of the accessory 382A). Another push notification is for motion happening in the garage (from the GDO's built in motion sensor) or get notification for motion happening outside the garage (from a motion sensor in a separate housing that is not physically connected to the GDO).

In some embodiments, further intelligence can be added to the IAA controller 330 via firmware updates periodically or on-the-fly upon receiving a user command that is not known on the local IAA controller 330. For example, the IAA controller 330 can be coupled to the server 250 (FIG. 4) via the network 254 (FIG. 4) allowing for greater sophistication with the IAA. A user can ask the IAA to provide detailed information to the user not normally available from a garage door opener.

Figure 9:
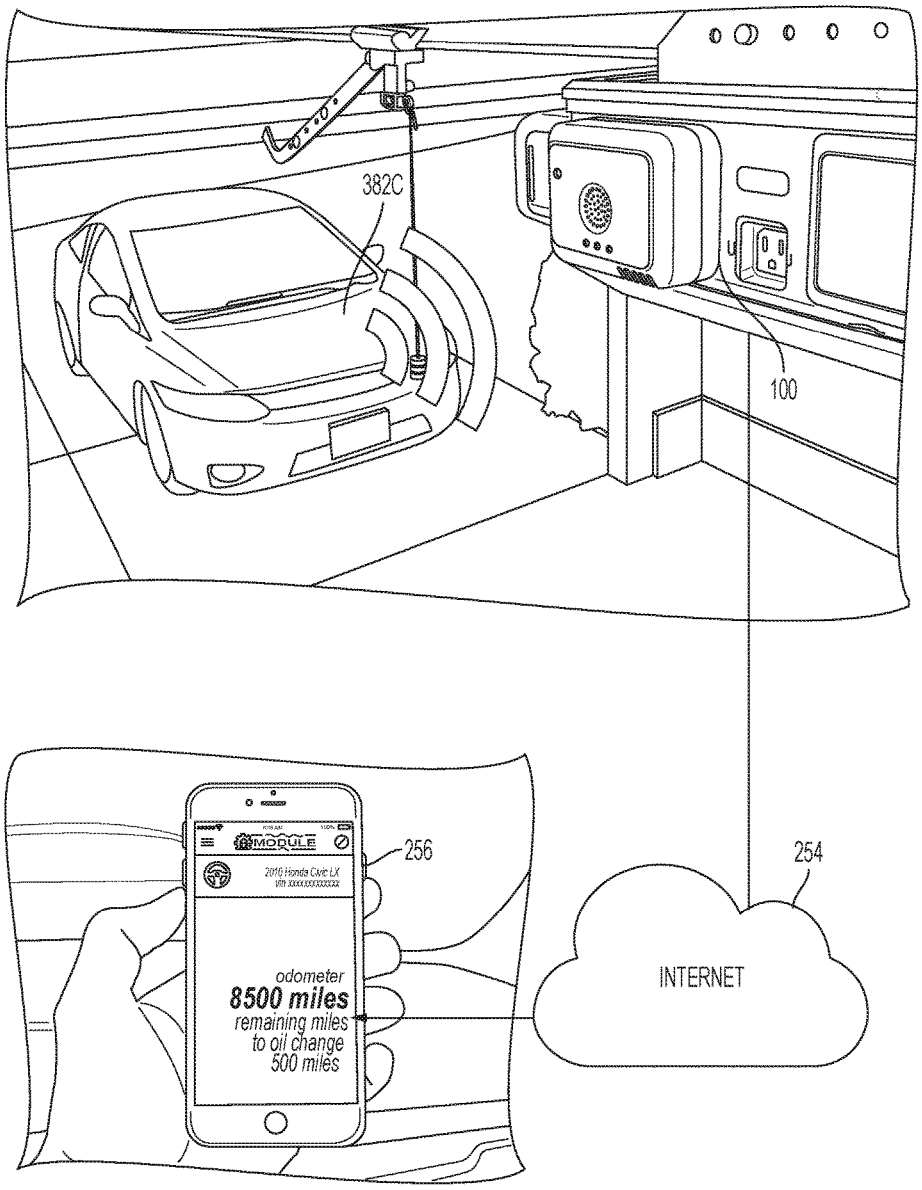
FIG. 9 shows using a personal wireless device communicating with the garage door opener of FIG. 2 to acquire information from a vehicle.

FIG. 9 shows a user communicating with a personal wireless device 256 to acquire information from the vehicle having the accessory 382C, via the IAA controller 330 of the garage door opener 100. The user may input a command that requests vehicle status via a GUI or voice command in the personal wireless device 256, and the personal wireless device 256 communicates the command to the garage door opener 100 via then network 254, or directly via a Bluetooth connection. Alternatively, the user may directly express a voice command for vehicle status to the garage door opener 110 via a microphone 275. As described above with respect to steps 765 and 760, the processor 330 interprets the user command for vehicle status and transmits an accessory command to the accessory 382C in the vehicle. In response to the request for vehicle status, the accessory 382C reads one or more vehicle sensors 420 or the memory 410 to access the vehicle status information, for example, the accessory 382C reads odometer and oil status information. The accessory processor 415 communicates the vehicle status information to the garage door opener 100 via the wireless transceivers 445 and the transceiver 345. The garage door opener controller 330 responds to the personal wireless device 256 by communicating the vehicle status via the transceiver 345 and the network 254 to the wireless device 256. The wireless device 256 may then present the vehicle status information to the user.

Figure 10:
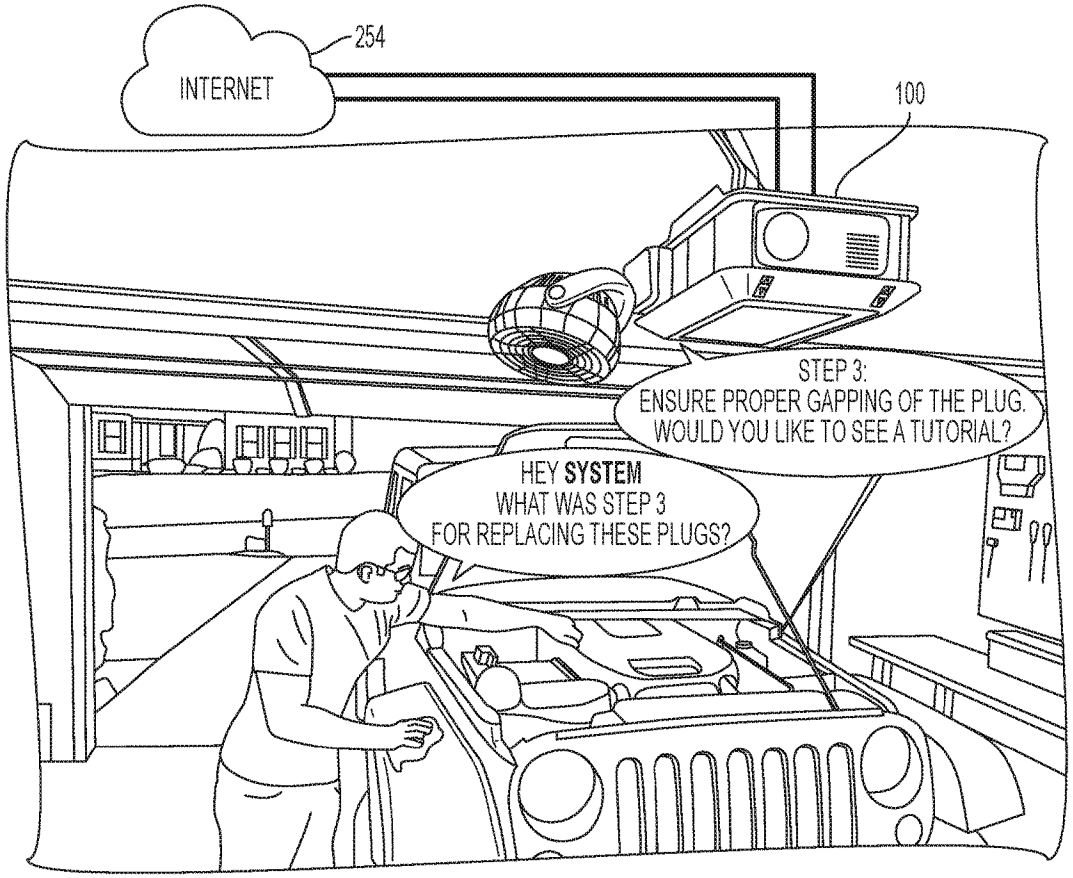
FIG. 10 shows a user communicating with an intelligent automated assistant of the garage door opener of FIG. 2.

FIG. 10 shows a user directly communicating with the IAA controller 330 of the garage door opener 100 to acquire information from a server 250 with the assistance of the IAA controller 330. The user may speak to the microphone 275 and request information (e.g., "hey system, what was step 3 for replacing these plugs?"). Voice recognition software in the controller 330 may recognize the user's request in audio data received from the microphone 275, and forward the request to the server 250 via the transceiver 345 and the network 254. The server 250 may return a response to the user's request and the controller 330 may use text to speech software to generate a voice response and communicate the response to the user via the speaker 280. In another embodiment, the controller 330 may receive the user request audio data from the microphone 175 and may forward the audio data to the server 250 to for voice recognition of the user's request, and to determine the response to the user's request.

Figure 11:
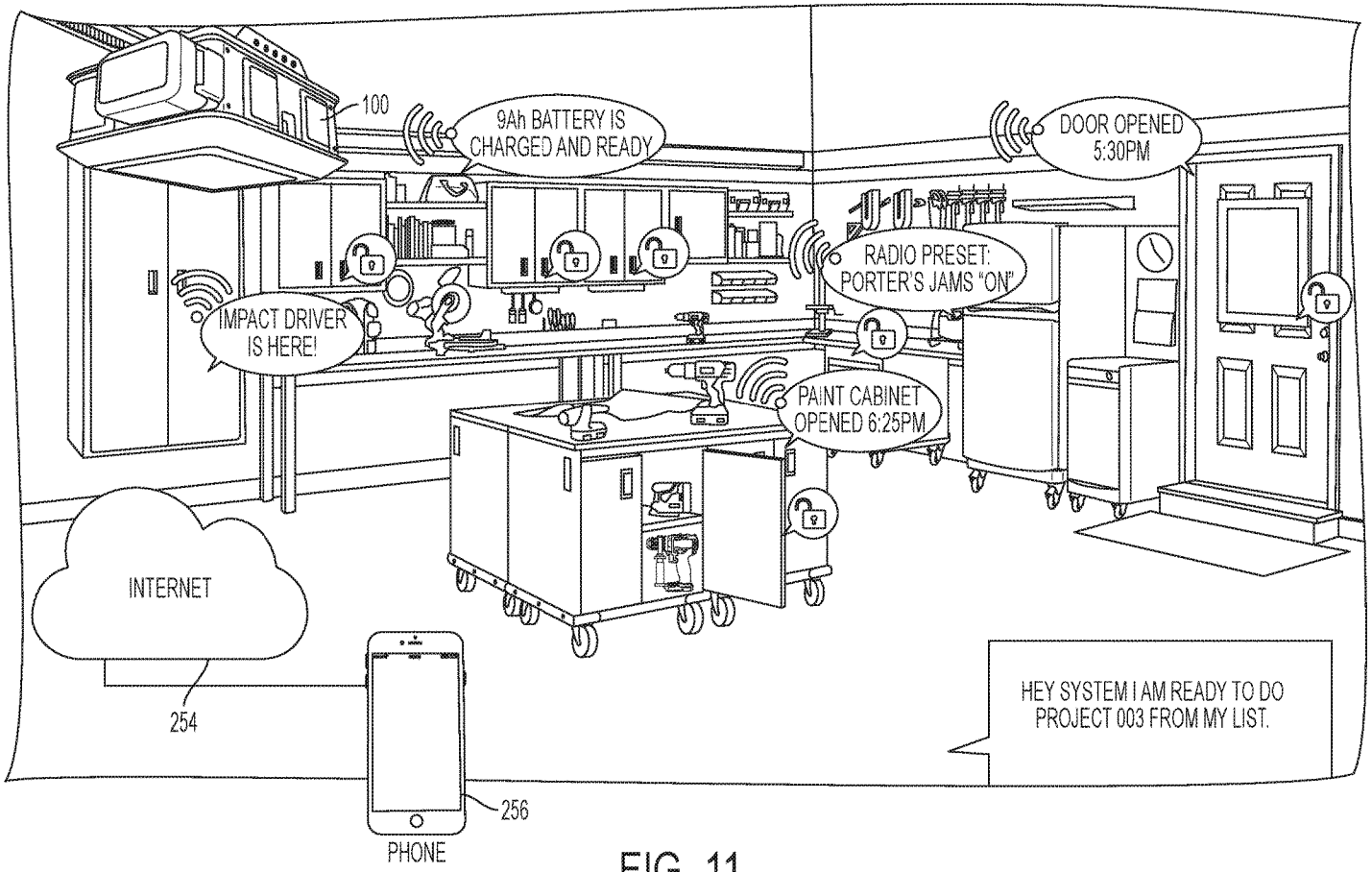
FIG. 11 shows various interactions with an intelligent automated assistant of the garage door opener of FIG. 2.

The IAA controller 330 can intelligently control accessory devices 382 coupled to the garage door opener 100. For example, a user may control the functionality of a job site radio 700 via the IAA controller 330. The user may voice a request or command to the microphone 275 to activate the radio, change radio volume or change a radio station (e.g., "hey system, turn up the radio"). Voice recognition software in the controller 330 may receive the audio data from the microphone 275 and recognize the user's request to raise the volume using voice recognition software. The controller 330 may generate and transmit a volume control command to the radio 700 via the transceivers 345 and 445 and, in response, the controller 405 in the radio 700 increases the volume of the radio 700. FIG. 11 shows various interactions with accessories 382 via the IAA controller 330 of the garage door opener 100. A user may communicate via the phone 256 to the garage door opener 100 to configure the IAA controller 330, to control operation of accessories 382 such as a cabinet door lock, a tracker device's audible or illuminating alert, a radio or music player, a side door lock, and/or a drawer lock, at a specified time or in response to a command. For example, the user may enter a request to "play Porter's jams" via the personal wireless device 256 using a voice command into a microphone in the device 256, or by inputting the command via a user interface, for example, a touch screen and a GUI. The personal wireless device 256 may communicate the user request to the garage door opener 100 via the network 254 or via a Bluetooth connection with the garage door opener 100, for example. The controller 330 may detect the user's command to play Porter's jams from the personal wireless device 256, and generate and wirelessly transmit a command to a music player via the transceivers 345 and 445. In response, the controller 405 in the music player selects a play list identified as Porter's jams and outputs a song from the playlist via a speaker in the music player. In another embodiment, the user may request that the command take effect a specified time. In this regard, the controller 330 may wait to deliver the command to the music player until the specified time is detected, for example, based on an internal clock, GPS, or from the server 254.

The processors described herein are electronic processors and may be configured to carry out the functionality attributed thereto via execution of instructions stored on a compute readable medium (e.g. one of the illustrated memories), in hardware circuits (e.g., an application specific integrated circuit (ASIC) or field programmable gate array) configured to perform the functions, or a combination thereof. Additionally, unless otherwise noted, the electronic processor may take the form of a single electronic processor or multiple electronic processors arranged in any form, including parallel electronic processors, serial electronic processors, tandem electronic processors or electronic cloud processing/cloud computing configurations.

Although the invention has been described in detail with reference to certain preferred embodiments, variations and modifications exist within the scope and spirit of one or more independent aspects of the invention as described.

What is claimed is:

1. A garage door opener system, the system comprising:

a garage door opener, the garage door opener having a garage door opener housing;

a motor for moving a garage door, the motor supported by the garage door opener housing;

a wireless communication interface supported by the garage door opener housing; and a garage door opener controller supported by the garage door opener housing and coupled to the motor and the wireless communication interface;

a user communication interface accessory including a microphone, wherein the user communication interface accessory is communicatively coupled to the garage door opener controller; and a garage door opener system accessory, wherein the garage door opener system accessory is communicatively coupled to the garage door opener controller;

wherein the garage door opener controller includes an electronic processor and a memory storing instructions that when executed by the electronic processor configure the garage door opener controller to:

detect a voice command received via the microphone of the user interface accessory, authenticate the voice command; and generate, in response to authenticating the voice command, a responsive control action to control the garage door opener system according to the voice command.

2. The system of claim 1, wherein the responsive control action controls the motor to open or close the garage door or controls the garage door opener system accessory.

3. The system of claim 1, wherein, to authenticate the voice command, the garage door opener controller supported by the garage door opener housing is further configured to determine a vocal characteristic of the voice command received via the microphone and to identify an authorized user of the garage door opener system based on the vocal characteristic.

4. The system of claim 1, further comprising a motion detector communicatively coupled to the garage door opener controller supported by the garage door opener housing, and wherein, to authenticate the voice command, the garage door opener controller supported by the garage door opener housing is further configured to determine that a user is located within the garage when the motion detector detects motion within the garage.

5. The system of claim 1, wherein, to authenticate the voice command, the garage door opener controller supported by the garage door opener housing is further configured to determine that a personal wireless device associated with an authorized user is located within an area associated with the garage door opener.

6. The system of claim 1, wherein the garage door opener system accessory is located remotely from the garage door opener and the garage door opener controller supported by the garage door opener housing, and the wireless communication interface communicates with the garage door opener system accessory utilizing an adaptive data rate scheme with data rates that range from 0.3 kbps to 50 kbps to generate the responsive control action.

7. The system of claim 6, wherein the garage door opener system accessory includes at least one selected from the group consisting of a driveway gate, a driveway gate alarm, a mailbox alarm, and a motion detector.

8. The system of claim 1, wherein a personal wireless device communicatively coupled to the garage door opener system includes speech recognition software, and to detect a voice command received via the microphone, the garage door opener controller supported by the garage door opener housing is further configured to:

generate audio data based on the voice command received via the microphone of the user communication interface accessory, transmit the audio data via the wireless interface of the garage door opener system to the personal wireless device for speech recognition of the audio data, and receive, via the wireless interface of the garage door opener system, a corresponding command identifier from the personal wireless device.

9. A method for controlling a garage door opener system including a garage door opener, the method comprising:

detecting, by a garage door opener controller including an electronic processor, a voice command received via a microphone of the garage door opener system, wherein the garage door opener includes a garage door opener housing that supports a motor and the garage door opener controller;

authenticating, by the garage door opener controller, the voice command; and generating, by the garage door opener controller supported by the garage door opener housing in response to authenticating the voice command, a responsive control action to control the garage door opener system according to the voice command, wherein the garage door opener system further includes a garage door opener accessory.

10. The method of claim 9, wherein the responsive control action one or more of controls the motor to open the garage door, controls the motor to close the garage door, and controls the garage door opener accessory.

11. The method of claim 9, wherein authenticating, by the garage door opener controller supported by the garage door opener housing, the voice command includes:

determining a vocal characteristic of the voice command received via the microphone, and identifying an authorized user of the garage door opener system based on the vocal characteristic.

12. The method of claim 9, wherein authenticating, by the garage door opener controller supported by the garage door opener housing, the voice command includes:

determining that a user is located within the garage when a motion detector of the garage door opener system detects motion within the garage.

13. The method of claim 9, wherein authenticating, by the garage door opener controller supported by the garage door opener housing, the voice command includes:

determining that a personal wireless device associated with an authorized user is located within an area associated with the garage door opener.

14. The method of claim 9, wherein the garage door opener accessory is located remotely from the garage door opener and the garage door opener controller supported by the garage door opener housing, and a wireless communication interface of the garage door opener system communicates with the remotely located garage door opener accessory utilizing an adaptive data rate scheme with data rates that range from 0.3 kbps to 50 kbps to generate the responsive control action.

15. The method of claim 14, wherein the garage door opener accessory includes at least one selected from the group consisting of a driveway gate, a driveway gate alarm, a mailbox alarm, and a motion detector.

16. The method of claim 9 wherein a personal wireless device communicatively coupled to the garage door opener system includes speech recognition software, and detecting, by the garage door opener controller supported by the garage door opener housing, the voice command received via the microphone of the garage door opener system includes:

generating audio data based on the voice command received via the microphone of the garage door opener system, transmitting the audio data via a wireless interface of the garage door opener system to the personal wireless device for speech recognition of the audio data, and receiving, via the wireless interface of the garage door opener system, a corresponding command identifier from the personal wireless device.

17. A garage door opener system, the system comprising:

a garage door opener, the garage door opener having a garage door opener housing;

a motor for moving a garage door, the motor supported by the garage door opener housing;

a wireless communication interface supported by the garage door opener housing; and a garage door opener controller supported by the garage door opener housing and coupled to the motor and the wireless communication interface;

a user communication interface accessory including a microphone, wherein the user communication interface accessory is communicatively coupled to the garage door opener controller; and a garage door opener system accessory, wherein the garage door opener system accessory is communicatively coupled to the garage door opener controller;

wherein the garage door opener controller includes an electronic processor and a memory storing instructions that when executed by the electronic processor configure the garage door opener controller to:

detect a voice command received via the microphone of the user interface accessory, authenticate the voice command, wherein, to authenticate the voice command, the garage door opener controller is further configured to at least one selected from the group of:

determine that a user is located within the garage when a motion detector detects motion within the garage, where the motion detector is communicatively coupled to the garage door opener controller, and determine that a personal wireless device associated with an authorized user is located within an area associated with the garage door opener; and generate, in response to authenticating the voice command, a responsive control action to control the garage door opener system according to the voice command.

18. The system of claim 17, wherein the responsive control action controls the motor to open or close the garage door or controls the garage door opener system accessory.

19. The system of claim 18, wherein the garage door opener system accessory is located remotely from the garage door opener and the garage door opener controller supported by the garage door opener housing, and wherein the garage door opener system accessory includes at least one selected from the group consisting of a driveway gate, a driveway gate alarm, a mailbox alarm, and a motion detector.

20. The system of claim 17, wherein a personal wireless device communicatively coupled to the garage door opener system includes speech recognition software, and to detect a voice command received via the microphone, the garage door opener controller supported by the garage door opener housing is further configured to:

generate audio data based on the voice command received via the microphone of the user communication interface accessory, transmit the audio data via the wireless interface of the garage door opener system to the personal wireless device for speech recognition of the audio data, and receive, via the wireless interface of the garage door opener system, a corresponding command identifier from the personal wireless device.

* * * * *